US005483901A

United States Patent [19]

Tisbo et al.

[11] Patent Number: 5,483,901

[45] Date of Patent: Jan. 16, 1996

[54] FOLDABLE TRAY TABLE

[75] Inventors: Thomas A. Tisbo, Barrington Hills; Stephen P. Whitehead, Elgin, both of Ill.

[73] Assignee: Suncast Corporation, Batavia, Ill.

[21] Appl. No.: 291,413

[22] Filed: Aug. 16, 1994

[51] Int. Cl.[6] ..... A47B 3/02

[52] U.S. Cl. ..... 108/119; 248/164

[58] Field of Search ..... 108/119, 118, 108/120, 115, 124, 132; 248/164, 432, 439, 588

[56] References Cited

U.S. PATENT DOCUMENTS

| | | | |
|---|---|---|---|
| 2,514,735 | 7/1950 | Wilson et al. | 108/119 |
| 2,871,075 | 1/1959 | Stone | 108/119 |
| 2,957,736 | 10/1960 | Olander et al. | 108/119 X |
| 3,103,900 | 9/1963 | Lippman | 108/119 X |
| 3,134,192 | 5/1964 | Huffer | 108/119 X |
| 3,166,028 | 1/1965 | Zagel | 108/119 X |
| 3,554,139 | 1/1971 | Rosner . | |
| 4,386,677 | 6/1983 | Gulezian | 108/118 X |
| 4,557,200 | 12/1985 | Geschwender . | |
| 4,796,314 | 1/1989 | Garduno | 108/118 X |
| 4,799,700 | 1/1989 | Knoedler et al. | 108/120 X |
| 4,850,286 | 7/1989 | Cline . | |
| 4,967,672 | 11/1990 | Leather | 108/120 |
| 5,353,715 | 11/1994 | Luyk | 108/119 X |

FOREIGN PATENT DOCUMENTS

| | | | |
|---|---|---|---|
| 673565 | 3/1990 | Switzerland | 108/118 |

*Primary Examiner*—Jose V. Chen
*Attorney, Agent, or Firm*—McHale & Slavin

[57] ABSTRACT

The present invention is a foldable tray table of modular construction with readily replaceable and interchangeable plastic molded components which can be assembled by hand and include a tray having an underside with a pair of first legs and second legs connected thereto. The upper end of each first leg has a journal pin operatively adapted for being disposed and snap-fit between one pair of journal mounting brackets formed on the underside of the tray. When its journal pin is so disposed, each first leg is pivotal relative to the tray. The second legs are joined together at their upper ends by an integral locking bar. A pivot plug is formed intermediate the ends of and extending from one of each of the first legs and the second legs for interconnecting with a pivot hole formed intermediate the ends of and in the other of each of the first legs and the second legs. Each pivot plug is operatively adapted for being snap-fit in one pivot hole such that each first leg and second leg so connected are pivotal relative to one another. Two clips are used to releasably connect the locking bar to the tray. Each clip is operatively adapted for being snap-fit in a snap-on hole in a clip mounting bracket formed on the underside of the tray opposite to the journal mounting brackets. The locking bar is releasably retained by each clip.

9 Claims, 3 Drawing Sheets

FOLDABLE TRAY TABLE

FIELD OF THE INVENTION

The present invention is related to the field of tables, and more particularly to foldable tray tables.

BACKGROUND OF THE INVENTION

Tables are arguably the most used piece of furniture in a home. A table can be used to support food items during preparation of meals and subsequent consumption. Typically it is desirable to prepare a meal in the kitchen of a home and dine at a fixed table. However, in many instances it is desirable to dine at other locations in the home such as on a patio, near a bed, or while sitting in front of a television. Unfortunately, most tables designed for meal preparation and dining are either permanently set in place or relatively large in size, making them either impossible or cumbersome to move. Various types of portable tables have been developed to solve this problem. These portable tables come in various sizes from full dining tables to individual tray tables and have included foldable or collapsible legs for ease in transport and efficient storage.

The advent of television has significantly helped to popularize the use of tray tables. The portable nature of tray tables has made them ideal for lining in front of the television or any other area in the home. Tray tables are made in a variety of sizes and designs having legs that are partially or fully separable from the tray and foldable for transporting and storage. Examples of prior art tray tables are disclosed in U.S. Pat. Nos. 4,850,286, 4,557,200 and 3,554,139. The components used in fabricating prior art foldable tray tables are disclosed typically made of metal and assembled using such fasteners as rivets and screws. Due to the fabrication costs of the individual tray table components as well as the costs of assembling the components, prior art tables are expensive. The equipment necessary to assemble the components can be automated but still adds to the cost of the tables. Since most retailers and consumers do not possess the appropriate equipment or skill to effect needed repairs, such tray tables typically must be repaired and reassembled at the factory, if at all. However, even if repairable, it is typically cheaper to simply replace a damaged or defective tray table rather than attempting its repair.

Tray tables of metal construction, especially those made of steel, are susceptible to rust and other forms of corrosion, limiting their use to indoor environments. This problem may be partially remedied by applying a protective coating or otherwise passivating exposed metal surfaces. However, such corrosion protection techniques significantly add to the costs of the tray table and the protective layer tends to wear off with use.

Therefore, there is a need for a less expensive tray table of modular construction capable of being assembled without tools, equipment, or special skill. A tray table that is foldable for easy transport and efficient storage. One that is corrosion resistant and yet strong and durable.

SUMMARY OF THE INVENTION

An objective of the present invention is to provide a foldable tray table of strong and durable plastic construction that is inexpensive to manufacture and repair.

An additional objective of the present invention is to provide a foldable tray table capable of being assembled by hand without the need for tools, equipment, or special skill.

Another objective of the present invention is to provide a foldable tray table made of readily replaceable and interchangeable components that can be snapped together.

Still another objective of the present invention is to provide a foldable tray table that is highly resistant to corrosion.

Yet another objective of the present invention is to provide a more aesthetically pleasing foldable tray table.

A further objective of the present invention is to provide a foldable tray table that is easily set-up and broken down for ease in transporting and efficient storage.

The above and other objectives of the present invention are obtained by providing a foldable tray table of modular plastic construction which includes a tray having a top surface, an underside, a first edge, a second edge opposite to the first edge and two side edges. The tray has two pair of spaced journal mounting brackets and at least one and preferably two spaced clip mounting brackets formed on its underside. The two pair of journal mounting brackets are located one on either side of the tray adjacent to the first edge. Each clip mounting bracket is located adjacent the second edge. Each of the brackets is an integral part of the tray with a pivot hole formed in each of the journal mounting brackets and a snap-on hole formed in the clip mounting bracket.

The present tray table also includes a pair of first legs and a pair of second legs, with each leg having an upper end and a lower end. Each leg is preferably hollow to reduce weight and cost while maintaining strength. The upper end of each first leg has a journal pin operatively adapted for being disposed between one pair of the journal mounting brackets and snap-fit in their pivot holes. When its journal pin is so disposed, each first leg is pivotal about its respective journal pin relative to the tray. The second legs are joined together at their upper ends by an integral locking bar, giving an overall U-shape appearance. A pivot plug is formed intermediate the ends of and extending from one of each of the first legs and the second legs for interconnecting with a pivot hole formed intermediate the ends of and in the other of each of the first legs and the second legs. Each pivot plug is operatively adapted for being snap-fit in one pivot hole such that each first leg and second leg so connected are pivotal relative to one another.

At least one and preferably two clips are used to releasably connect the locking bar to the tray. Each clip is operatively adapted for being snap-fit in one snap-on hole and thereby held to the tray at the clip mounting bracket. The locking bar and each clip are operatively adapted such that the locking bar is releasably retained by each clip.

One feature of the present foldable tray table is the journal pin of each first leg not being as easily removable from the tray, once snap-fit in its corresponding pivot holes, compared to the locking bar, once retained by each clip. Because of this construction, consumers will not be confused as to which legs to detach from the tray when storing the tray table.

With its modular plastic construction of readily replaceable and interchangeable components, the present foldable tray table is less expensive to manufacture and repair. Rather than needing any equipment or special skill, almost anyone can easily and quickly assemble the present foldable tray table by hand. Being constructed from high strength plastic components, the present tray table is very durable, and the need for costly corrosion resistant coatings or other passivating processes is eliminated.

The above and other objectives, features, and advantages of the present invention will become apparent upon consideration of the detailed description and the appended drawings.

DETAILED DESCRIPTION OF THE INVENTION

Although the present invention is herein described in terms of a specific embodiment, it will be readily apparent to those skilled in this art that various modifications, rearrangements, and substitutions can be made without departing from the spirit of the invention. The scope of the present invention is thus only limited by the claims appended hereto.

Figure 1:
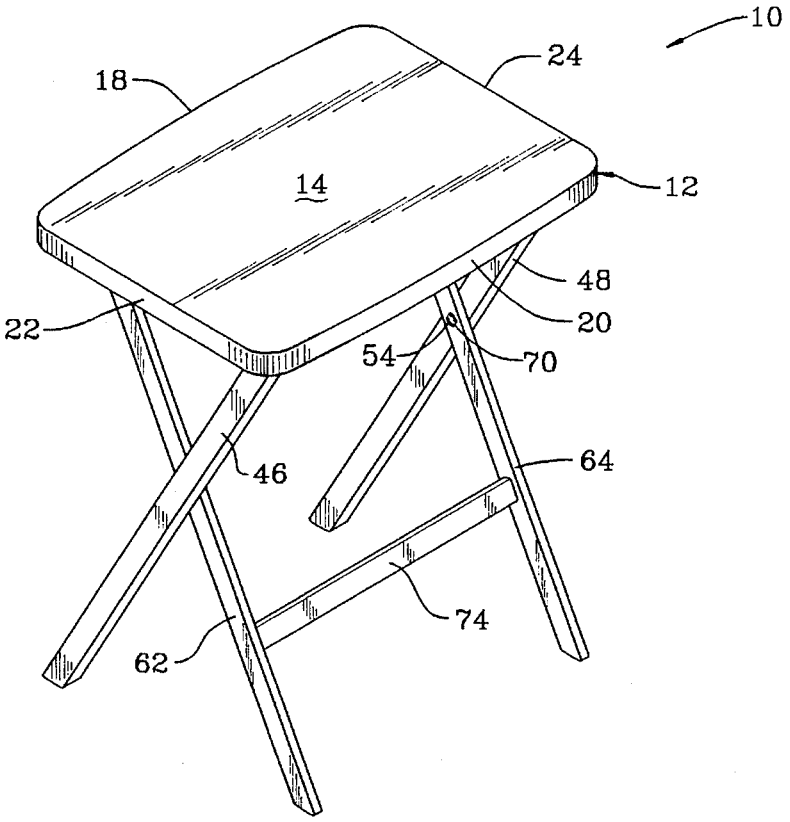
FIG. 1 is a perspective view of one embodiment of the present foldable tray table in its fully assembled and upright standing condition.
Figure 4:
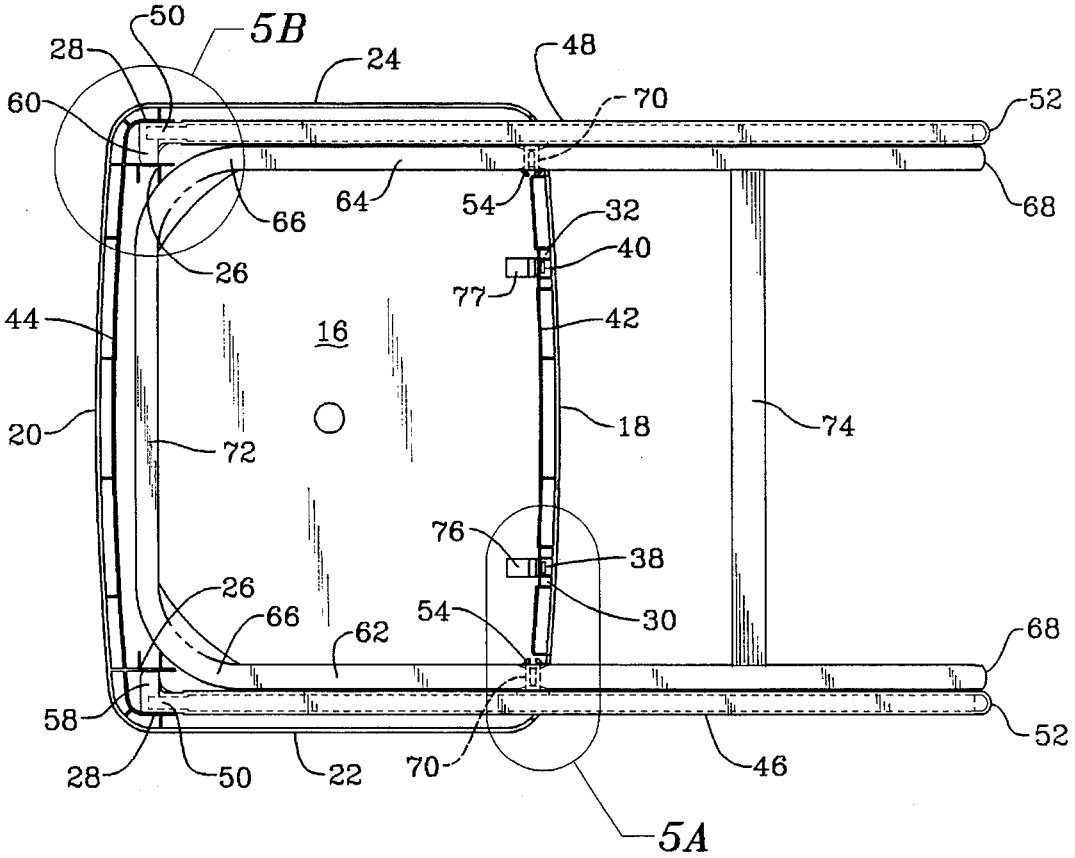
FIG. 4 is a plan view of the tray table of FIG. 1 in a fully folded and flat condition with the underside of its tray facing up.

Referring to FIGS. 1 and 4, one embodiment of the present foldable tray table 10 is fully modular in construction, with high strength plastic components that include an injection molded plastic tray 12 having a top surface 14, an underside 16, a front edge 18, an opposite back edge 20 and two side edges 22 and 24. Two pair of spaced journal mounting brackets 26 and 28 and two spaced clip mounting brackets 30 and 32 are formed on the underside 16 as an intricately molded part of the tray 12. Each of the journal mounting brackets 26 and 28 has a upper pivot hole 34 and 36 formed therethrough. Each of the clip mounting brackets 30 and 32 has a snap-on hole 38 and 40 respectively formed therethrough. The front and back edges 18 and 20 are structurally supported by respective ribbing 42 and 44. The two pair of spaced journal mounting brackets 26 and 28 are located one on either side of the tray 12 adjacent to the back edge 20. The clip mounting brackets 30 and 32 are located adjacent to the front edge 18. Each journal mounting bracket 28 is formed by part of support ribbing 44 and both clip mounting brackets 30 and 32 are partially formed by support ribbing 42.

Figure 2:
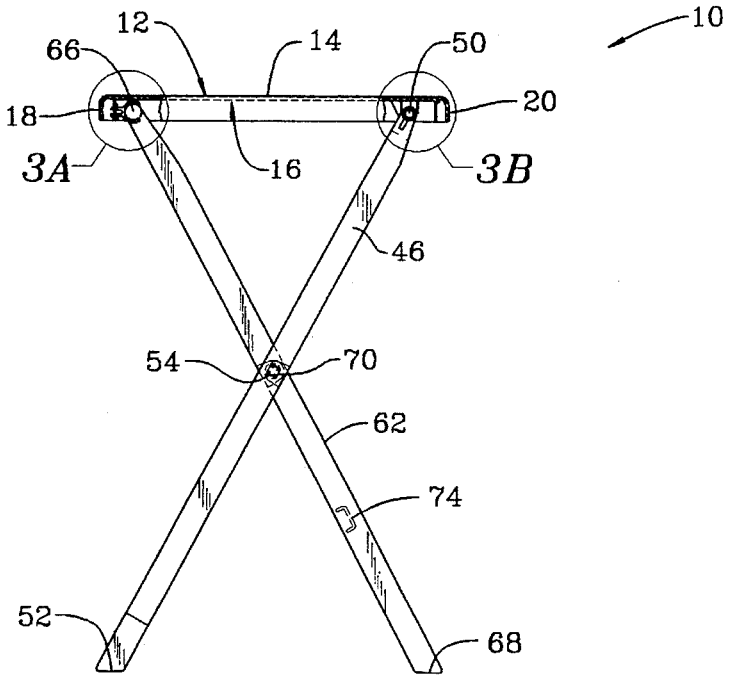
FIG. 2 is a partially broken away side view of the foldable tray table of FIG. 1.
Figure 5A:
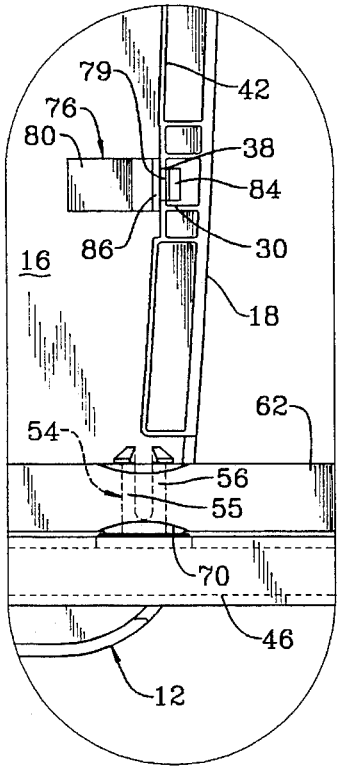
FIG. 5A and 5B are respectively enlarged views of circled areas 5A and 5B of FIG. 4.
Figure 5B:
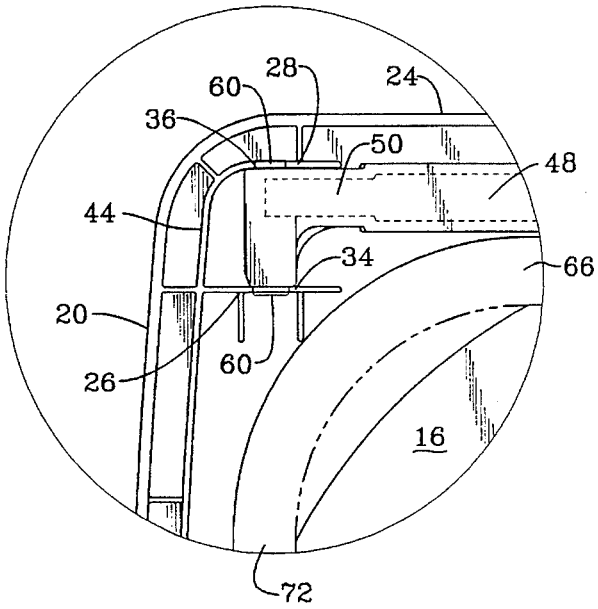

Referring to FIGS. 2 and 4, tray table 10 also includes a pair of molded plastic outer legs 46 and 48 that are preferably made hollow, for example by being molded from a plastic parison formed by a gas assisted injection molding process or a blow-molding extrusion process. Each outer leg 46 and 48 has an upper end 50, a lower end 52 and a pivot plug 54 formed intermediate the two ends 50 and 52. Referring to FIG. 5A, each pivot plug 54 is formed by two spaced resilient locking prongs 55 and 56 extending perpendicularly out therefrom. Each plug 54 is an intricate part of it respective outer leg 46 and 48. The upper end 50 of each outer leg 46 and 48 is in the form of a journal pin 58 and 60, respectively. Referring to FIGS. 3B and 5B, each journal pin 58 and 60 is operatively adapted for being disposed between one pair of the journal mounting brackets 26 and 28 and snap-fit in the corresponding upper pivot holes 34 and 36 such that each outer leg 46 and 48 is pivotable about its journal pin 58 and 60 relative to the tray 12.

Tray table 10 further includes a pair of molded plastic inner legs 62 and 64 are hollow construction. Each inner leg 62 and 64 has an upper end 66, a lower end 68 and an intermediate pivot hole 70 formed therethrough at a point intermediate its ends (see FIG. 5A). The upper ends 66 of the inner legs 62 and 64 are joined together by a locking bar 72 formed as an intricately molded part thereof. Preferably, a crossbar 74 is also formed as an intricately molded connection between the inner legs 62 and 64 at a point intermediate their intermediate pivot holes 70 and lower ends 68. Cross bar 74 adds structural stiffness to inhibit bowing of inner leg 62 and 64. The lower ends 52 and 68 of each leg 46, 48, 62 and 64 are preferably beveled to better stabilize the present tray table 10 when in its fully assembled and upright standing condition (See FIG. 2). The locking prongs 55 and 56 of each pivot plug 54 are operatively adapted for being snap-fit in one of the intermediate pivot holes 70 such that each outer leg 46, 48 and inner leg 62, 64 connected in this manner are pivotal relative to one another about their corresponding pivot plug 54 and pivot hole 70 connection.

Figure 3A:
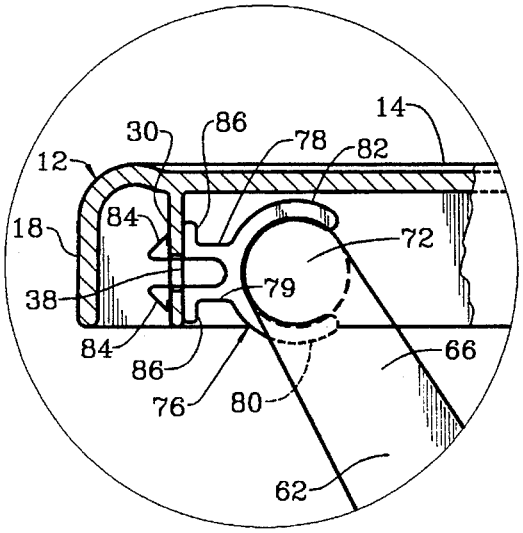
FIGS. 3A and 3B are respectively enlarged views of circled areas 3A and 3B of FIG. 2.
Figure 3B:
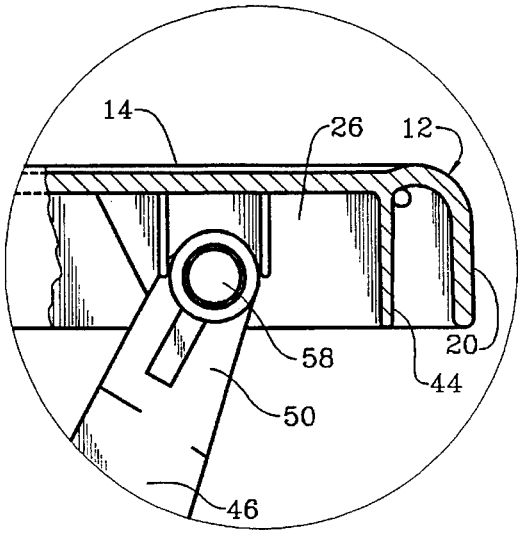

Referring to FIGS. 3A and 5A, two C-shaped clips 76 and 77 are used to releasably connect the locking bar 72 and thereby the inner legs 62 and 64 to the underside 16 of tray 12. Each clip 76 and 77 is of molded plastic construction with a pair of resilient locking prongs 78 and 79 extending rearward from two resilient clipping arms 80 and 82 formed in a general C-shape. Each locking prong 78 and 79 has a leading barb 84 and a trailing stop lip 86 spaced therebehind. The prongs 78 and 79 on each clip 76 and 77 are operatively adapted for being snap-fit in one of the snap-on holes 38 and 40 such that a portion of each clip mounting bracket 30 and 32 is respectively disposed between the barbs 84 and stop lips 86 of the corresponding prongs 78 and 79. With the clips 76 and 77 so connected to the tray 12, the locking bar 72 is connected to the underside 16 of tray 12 by being forced against and deflecting the clipping arms 80 and 82 apart in order to either encircle and thereby retain the locking bar 72 with the arms 80 and 82 or to remove the locking bar 72 once so retained.

Figure 6:
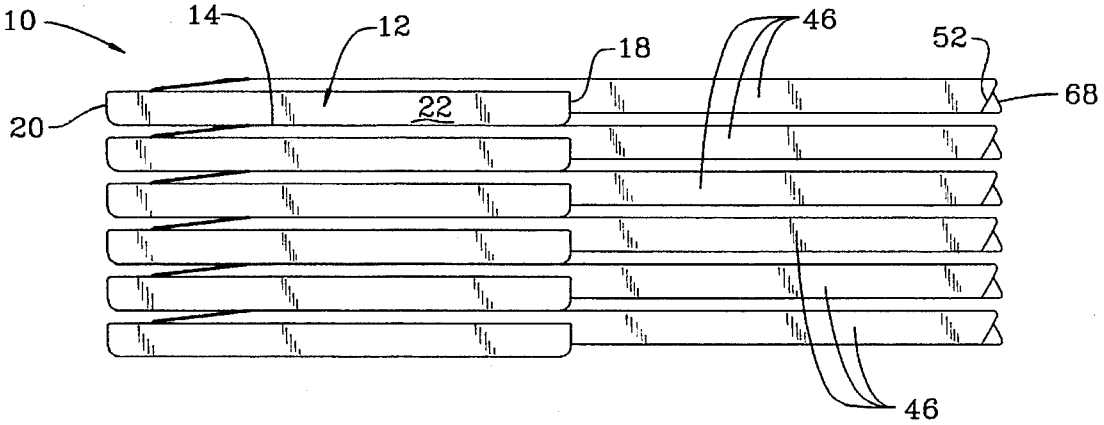
FIG. 6 is a side view of a plurality of the folded tray table of FIG. 4 vertically stacked one on top of each other.

To setup the present tray table 10 in an upright standing condition as shown in FIG. 1, its individual components are initially snapped together as previously described above. Finally, the locking bar 72 is forced past the free ends of the clipping arms 80 and 82 of each clip 76 and 77 until fully encircled by arms 80 and 82 (See FIG. 3A). To store a fully assembled tray table 10, the locking bar 72 is pulled out of the clips 76 and 77, deflecting arms 80 and 82 apart in the process. The inner legs 62 and 64 are then pivoted about their intermediate pivot poles 70 until they lie within and are generally coplaner with the outer legs 46 and 48. Tray 12 is then pivoted around journal pins 58 and 60 until it rests against legs 46, 48, 62 and 64, bringing the tray table 10 to its fully folded and flat condition (See FIG. 4). As can be seen in FIG. 6, a plurality of the tray tables 10 can be easily stacked in a compact group for efficient storage when in this fully folded condition.

From the above disclosure of the general principles of the present invention and the preceding detailed description, those skilled in this art will readily comprehend the various modifications to which the present invention is susceptible. For example, each of the outer legs 46 and 48 could be formed with the pivot hole 70 and each of the inner legs 62 and 64 could be formed with the pivot plug 54 without falling outside of the intended scope of the present invention.

Therefore, the scope of the present invention should be limited only by the following claims and equivalents thereof.

What is claimed is:

1. A modular foldable tray table comprising:

a tray having a top surface, an underside, a first edge, a second edge opposite to said first edge and two side edges, said tray having two pair of spaced journal mounting brackets and at least one clip mounting bracket formed on said underside, said two pair of journal mounting brackets being located one on either side of said tray adjacent to said first edge, said clip mounting bracket being located adjacent said second edge, each of said brackets being an integral part of said tray with an upper pivot hole formed in each of said journal mounting brackets and a snap-on hole formed in said clip mounting bracket;

a pair of first legs, each first leg having an upper end and a lower end, the upper end of each of said first legs having a journal pin operatively adapted for being disposed between and snap-fit in said upper pivot holes of one of said pair of journal mounting brackets, when so disposed, each said first leg being pivotal about its respective journal;

a pair of second legs, each second leg having an upper end and a lower end, said second legs being joined together by a locking bar at their upper ends, a pivot plug being formed intermediate the ends of and extending from one of each said first legs and each said second legs for interconnecting with an intermediate pivot hole formed intermediate the ends of and in the other of each said first legs and each said second legs, each said pivot plug being operatively adapted for being snap-fit in one of said intermediate pivot holes such that each first leg and second leg so connected are pivotal relative to one another thereby; and at least one clip operatively adapted for being snap-fit in said snap-on hole and thereby held to said clip mounting bracket, said locking bar and said clip being operatively adapted for said locking bar being releasably retained by said clip.

2. The modular foldable tray table of claim 1, each said pivot plug being formed by two spaced resilient locking prongs operatively adapted for being snap-fit in one of said intermediate pivot holes formed intermediate the ends of and in the other of each said first legs and each said second legs.

3. The modular foldable tray table of claim 1, said at least one clip having two resilient locking prongs operatively adapted for being snap fit in said snap-on hole.

4. The modular foldable tray table of claim 3, each prong on said clip having a leading barb and a trailing stop surface spaced therefrom, the prongs on said clip being operatively adapted for being snap fit in said snap-on hole such that a portion of said clip mounting bracket is wedged between the barb and stop surface of each prong on said clip.

5. The modular foldable tray table of claim 1, said at least one clip having two resilient clipping arms that together have a general C-shape, said clipping arms being operatively adapted for being deflected apart in order to either encircle and retain said locking bar or to allow the removal of the locking bar previously so retained.

6. The modular foldable tray table of claim 1, including an integral cross bar connecting said second legs above their lower ends, the lower end of each said leg being beveled.

7. The modular foldable tray table of claim 1, each said journal pin being operatively adapted for being snap-fit in the pivot holes of one of said pair of journal mounting brackets.

8. A modular foldable tray table comprising: a molded plastic tray having a top surface, an underside, a first edge, a second edge and two side edges, said tray having two pair of spaced journal mounting brackets and two spaced clip mounting brackets formed on said underside, said two pair of journal mounting brackets being located one on either side of said tray adjacent to said first edge, and clip mounting brackets being located adjacent to said second edge, each of said brackets being an integrally molded part of said tray with an upper pivot hole formed in each of said journal mounting brackets and a snap-on hole formed in each of said clip mounting brackets;

a pair of molded plastic first legs, each first leg having an upper end and a lower end, the upper end of each of said first legs forming a journal pin operatively adapted for being disposed between and snap-fit in the pivot holes of one of said pair of journal mounting brackets;

a pair of molded plastic second legs, each second leg having an upper end and a lower end, the upper ends of said second legs being joined together by an integrally molded locking bar, a pivot plug being formed intermediate the ends of and extending from one of each said first legs and each said second legs for interconnecting with an intermediate pivot hole formed intermediate the ends of and in the other of each said first legs and each said second legs, each said pivot plug being operatively adapted for being snap-fit in one of said intermediate pivot holes such that each first leg and second leg so connected are pivotal relative to one another about their corresponding pivot plug; and two molded plastic clips, with each of said clips being operatively adapted for being snap-fit in one of said snap-on holes and have two resilient clipping arms formed in a general C-shape for releasably retaining said locking bar.

9. A modular foldable tray table comprising: a molded plastic tray having a top surface, an underside, a first edge, a second edge and two side edges, said tray having two pair of spaced journal mounting brackets and two spaced clip mounting brackets formed on said underside, said two pair of journal mounting brackets being located one on either side of said tray adjacent to said first edge, said clip mounting brackets being located adjacent said second edge, each of said brackets being an integrally molded part of said tray with an upper pivot hole formed in each of said journal mounting brackets and a snap-on hole formed through a portion of each of said clip mounting brackets;

a pair of molded plastic outer legs, each outer leg having an upper end, a lower end and a pivot plug intermediate its ends with dual resilient locking prongs extending therefrom, the upper end of each of said outer legs forming a journal pin operatively adapted for being disposed between and snap-fit in the pivot holes of one of said pair of journal mounting brackets;

a pair of molded plastic inner legs, each inner leg having an upper end, a lower end and an intermediate pivot hole formed intermediate the ends of and in the other of each said first legs and each said second legs, said inner legs being joined together by an integrally molded locking bar at their upper ends and an integral molded cross bar intermediate their lower ends and their said intermediate pivot holes, the locking prongs of each said pivot plug being operatively adapted for being snap-fit in one of said intermediate pivot holes such that each outer leg and inner leg so connected are pivotal relative to one another about their corresponding pivot plug, the lower end of each said leg being beveled; and two molded plastic C-shaped clips with each of said clips having two resilient clipping arms formed in a general C-shape and two resilient locking prongs, each prong on each said clip having a leading barb and a trailing stop surface spaced therefrom operatively adapted for being snap-fit in one of said snap-on holes such that the portion of one of said clip mounting brackets is disposed between the barb and stop surface, said clipping arms being operatively adapted for being deflected apart by said locking bar in order to either encircle and retain said locking bar and thereby releasably connect said locking bar to said tray or to allow the removal of the locking bar previously so retained.

* * * * *